United States Patent [19]

Smith, Jr.

[11] 3,970,306

[45] July 20, 1976

[54] HOCKEY GAME

[76] Inventor: Carl E. Smith, Jr., 10 Hemenway Road, Framingham, Mass. 01701

[22] Filed: July 7, 1975

[21] Appl. No.: 593,213

[52] U.S. Cl. ..... 273/85 F; 273/129 A

[51] Int. Cl.[2] ..... A63F 7/06; A63F 7/10

[58] Field of Search..... 273/85 F, 85 R, 129 R; 124/16, 26, 42

[56] References Cited

UNITED STATES PATENTS

| | | | |
|---|---|---|---|
| 1,997,238 | 4/1935 | Sharp | 124/26 |
| 3,822,688 | 7/1974 | Mayne | 124/42 X |
| 3,889,952 | 6/1975 | Shiga | 273/85 R X |

FOREIGN PATENTS OR APPLICATIONS

| | | | |
|---|---|---|---|
| 658,874 | 3/1938 | Germany | 273/85 F |
| 430,680 | 6/1935 | United Kingdom | 124/126 |
| 1,209,275 | 10/1970 | United Kingdom | 273/85 F |

*Primary Examiner*—Paul E. Shapiro
*Attorney, Agent, or Firm*—John E. Toupal

[57] ABSTRACT

A hockey game for simulating the conditions that exist in ice hockey during "one on one" confrontations between a shooter and a goalie. The game includes a miniature hockey goal positioned on a playing surface, a goalie member horizontally and vertically movable in front of the goal by a player attempting to intercept pucks shot on goal, and a shooter having an actuator with a spring loaded firing mechanism that can be cocked and triggered to propel a puck in predetermined trajectories. The shooter is manually manipulatable by an opponent of the player into selective orientations that establish the predetermined trajectories which are kept secret from the player by a housing that conceals the actuator. During play of the game, the offensive participant loads the shooter with a puck and selects a trajectory that will propel the puck toward a predetermined area of the goal while the defensive participant attempts to anticipate his opponent's action and move the goalie member in front of the anticipated area of the goal to block the discharged puck.

5 Claims, 4 Drawing Figures

HOCKEY GAME

BACKGROUND OF THE INVENTION

This invention relates to a hockey game and, more particularly, to a game for simulating the ice hockey strategy involved in the individual competition between one attempting to shoot a puck into a goal and a defending goalie.

Various games have been developed for simulating certain aspects of the play pursued in ice hockey. In most such games a puck is propelled along a playing surface either directly by a participant attempting to score a goal or by a simulated skater mounted on a playing board and manipulatable by a participant. Similarly, the goal is protected either by an opponent directly or by simulated skaters or a goalie mounted on the board and manipulated by the opponent. Although such games have achieved substantial popularity, success or failure in the outcome of such games is determined primarily by the manual dexterity of the players. Missing are the general strategical aspects that have made ice hockey such a popular sport and the specific strategy involved in one on one situations wherein a single skater attempts to score by shooting a puck by a defending goalie into the net. During such confrontations, a skilled shooter can provide various shooting trajectories that will result in movement of the puck toward a particular area of the goal, i.e., upper left corner, lower rignt corner, short side, wide side, etc. The goalie attempts to anticipate that shot and move to protect the particular area of the goal in which the shot is expected. These strategical aspects of hockey are not provided by known games wherein all shots are made at the same level, i.e., the playing surface, and wherein the horizontal trajectory of a fired puck is apparent to the goalie at the time a shot is made.

The object of this invention, therefore, is to provide a hockey game which more clearly re-creates the strategy involved in ice hockey during one to one confrontations between a shooter and a goalie.

SUMMARY OF THE INVENTION

This invention is a hockey game for simulating the conditions that exist in ice hockey during one to one confrontations between a shooter and a goalie. The game includes a miniature hockey goal positioned on a playing surface, a goalie member horizontally and vertically movable in front of the goal by a player attempting to intercept pucks shot on goal, and a shooter having an actuator with a spring loaded firing mechanism that can be cocked and triggered to propel a puck in predetermined trajectories. The shooter is manually manipulatable by an opponent of the player into selective orientations that establish the predetermined trajectories which are kept secret from the player by a housing that conceals the actuator. During play of the game, the offensive participant loads the shooter with a puck and selects a trajectory that will propel the puck toward a predetermined area of the goal while the defensive participant attempts to anticipate his opponent's action and move the goalie member in front of the anticipated area of the goal to block the discharged puck.

In a preferred embodiment of the invention, the actuator comprises a vertical adjustment for manually setting the vertical component of a selected trajectory and a horizontal adjustment for manually setting the horizontal component of the trajectory. Before each shot on goal, the shooter gains access to the concealed actuator by opening a lid on the housing and sets the vertical and horizontal adjustment for a desired trajectory. He then closes the lid to hide the selected adjustments from the player and actuates a trigger mechanism that induces forcible release of the puck into the selected path.

An additional feature of the invention is the provision for the shooter housing of a non-planar bottom surface that can be rocked upon the playing surface so as to selectively alter the elevation of a discharge orifice through which the puck is propelled. By appropriately rocking the shooter housing the opponent can instantaneously induce variations in a trajectory initially determined by setting of the actuator's vertical adjustment.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
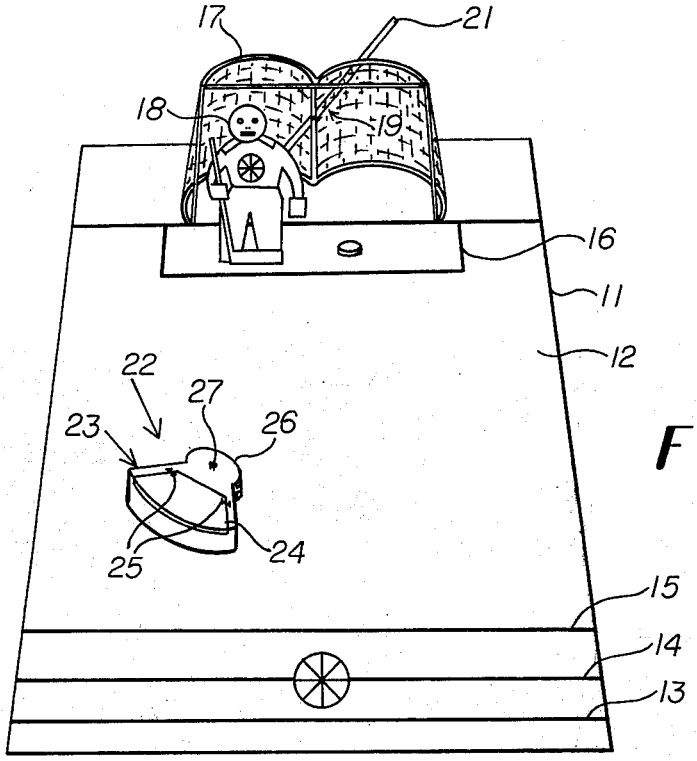
FIG. 1 is a schematic perspective view of a game according to the invention.

Referring now to FIG. 1 there is shown a playing board 11 having a surface 12 on which are imprinted the red, blue and goal crease lines 13–16 typically utilized on ice hockey surfaces. Mounted on the board 11 adjacent the crease lines 16 is a miniature goal 17 having a configuration similar to that used for conventional ice hockey goals. A miniature goalie member 18 which a surface area smaller than the opening to the goal 17 occupies a position in front thereof. The goalie member 18 is on one end of a stick 19 that extends under the goal 17 and beyond the edge of the board 11. A participant manipulating an extended portion 21 of the stick 19 can move the goalie member 18 both vertically and horizontally so as to cover a predetermined portion of the opening defined by the goal 17.

Also positioned on the playing surface 12 and freely movable thereon is a shooter 22 that can be operated by an opponent to propel pucks toward the goal 17. The shooter 22 includes a housing 23 with a lid attached thereto by pivots 25. One end of the housing 23 defines a discharge orifice 26 through which pucks are propelled in response to actuation of a trigger member 27 as described in greater detail hereinafter.

Figure 2:
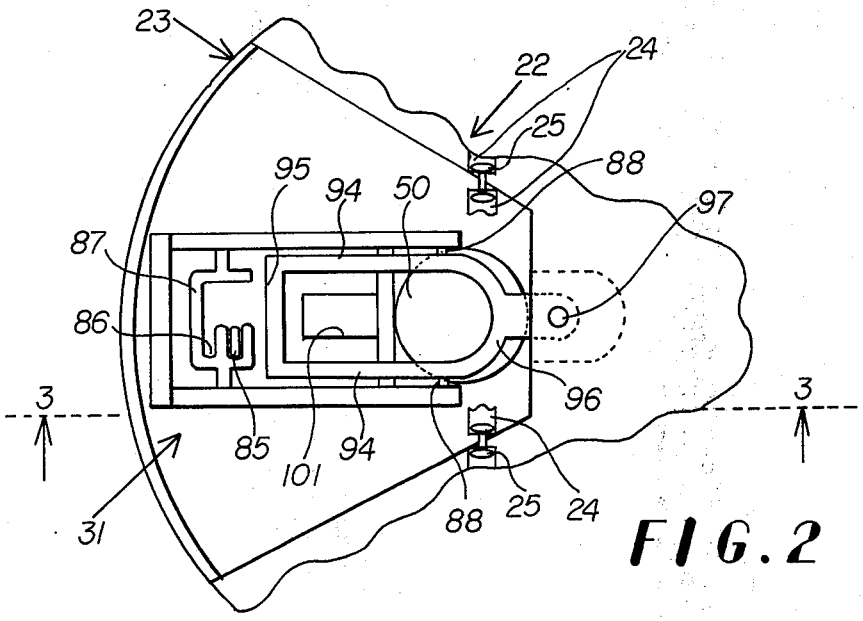
FIG. 2 is a top view of the shooter shown in FIG. 1 with a lid opened to expose a puck actuator mechanism.
Figure 3:
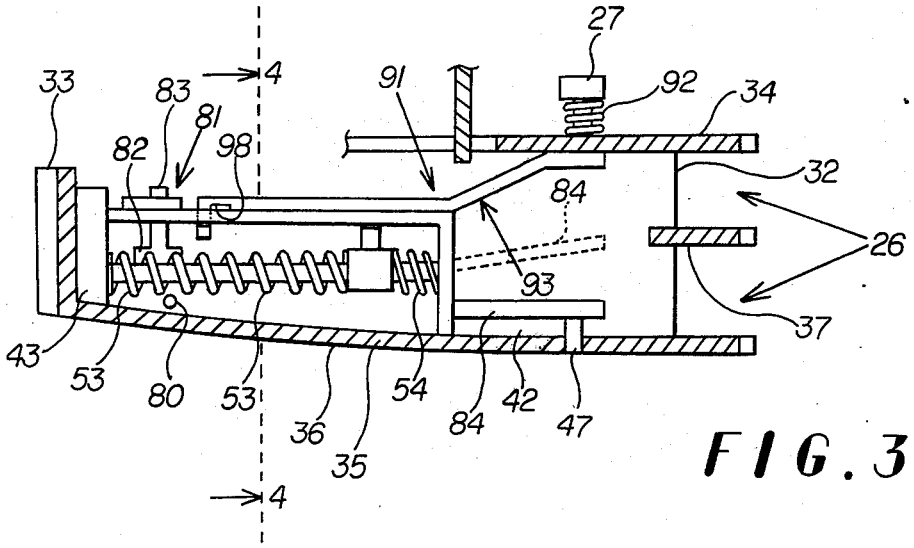
FIG. 3 is a cross-sectional view taken along lines 3—3 of FIG. 2.
Figure 4:
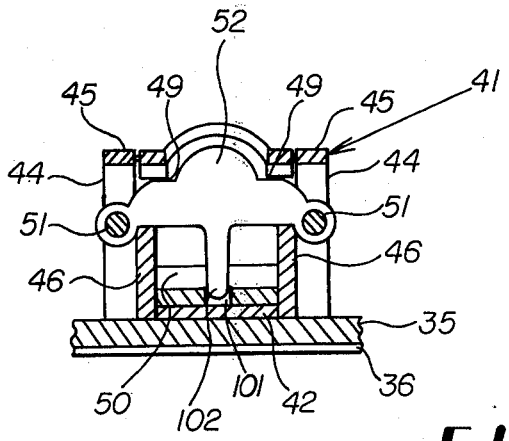
FIG. 4 is a cross-sectional view taken along lines 4—4 of FIG. 3.

FIG. 2 shows that shooter 22 with the lid 24 pivoted from a horizontal into a vertical position to expose a puck actuator 31. As shown in FIGS. 2–4 the actuator 31 includes a pair of side walls 32, an arcuate rear wall 33, a top wall 34 and a bottom wall 35 with a non-planar surface 36 that rests upon the playing surface 12 shown in FIG. 1. Defined by an end of the housing 23 opposite the rear wall 33 in the discharge orifice 26 that is divided into two parts by a horizontal baffle 37 extending between the side walls 32.

The actuator 31 further includes a framework 41 formed by a bottom wall 42 that conforms to the bottom wall 35 of the housing 23, a vertical back wall 43, a pair of spaced apart vertical legs 44 opposite thereto, and a pair of horizontal spaced apart arms 45 each extending between the rear wall 43 and one of the legs 44. The framework 41 also includes a pair of vertical spaced apart guide walls 46 one extending upwardly from the bottom wall 42 between the rear wall 43 and each of the legs 44. A pin 47 engaging the bottom wall 35 of the housing 23 and a front portion of the actuator's bottom wall 42 permits horizontal pivotal movement of the framework 41 within the housing 23.

The actuator 31 additionally includes a puck firing mechanism including a pair of guide rods 51 each extending between the rear wall 43 and one of the legs 44 directly below one of the framework arms 45. Mounted for movement along the guide rods 51 is a yoke member 52 that serves as a catapult for propelling a puck 50 as described in greater detail below. Extending between the rear wall 43 and the yoke member 52 on each of the guide rods 51 is a compressed spring member 53. A similar spring 54 on each of the guide rods 51 extends between the yoke 52 and each of the legs 44.

Another element of the actuator 31 is a vertical adjustment mechanism 81 comprising a center block 82 mounted on a pivot pin 80 that extends between the guide walls 46. Attached to the center block 82 for pivotal movement parallel to the pivot 80 is an operating lever 83. Also extending from the block 82 in a direction orthogonally related to the lever 83 is a guide ramp 84 that rests upon and conforms to the bottom wall 42 of the framework 41. The lever 83 is pivotally connected to the center block 82 so as to be movable into and out of a front slot 85 and a rear slot 86 formed in a bracket member 87 supported between the arms 45.

The final assembly making up the actuator 31 is a puck release mechanism 91 that includes the trigger 27 shown in FIG. 1. The trigger 27 which is biased outwardly by a spring 92 extends through the top wall 34 of the housing 23 and engages one end of a pivot member 93 connected between the arms 45 by pivot pins 88. The pivot member 93 is a rectangular frame formed by side members 94, a rear end member 95 and an arcuate front end member 96 having a lip extension 97 that is engaged by the trigger pin 27. Cut into the underside of each of the side members 94 adjacent the rear member 95 is a notch 98 that receives accommodating portions 49 of the yoke 52 during cocking of the firing mechanism as described below.

During play of the game, an offensive player opens the lid 24 of the shooter 22 as shown in FIG. 2 providing access to the actuator 31. He then prepares the shooter 22 for firing a puck by cocking the catapult yoke 52. Cocking is accomplished by drawing the yoke back on the guide rod 51 against the bias of the compression springs 53 until it is directly below the recesses 98 of the side member 94, which being heavier than the arcuate portion 96 drops downwardly to engage the accommodating portions 49 and thereby secure the yoke 52 in place. The puck 50 can be inserted either before or after the cocking operation.

Next, the offensive participant selects a desired firing trajectory by making horizontal and vertical adjustment of the actuator 31. A horizontal adjustment is made by merely rotating the framework 41 around the pin 47 until the desired orientation is achieved. A vertical adjustment is made by appropriate manipulation by the lever 83. With the lever 83 in the front slot 85, the ramp 84 is in the position shown by solid lines in FIG. 3 and results in discharge of the puck along the playing surface 12. Conversely, movement of the lever 83 into the back slot 86 elevates the ramp 84 into the position shown by dotted lines in FIG. 3 and results in a puck trajectory above the playing surface 12. During this elevation of the ramp 84, a slot 101 therein accommodates a downwardly extending appendage 102 on the yoke 52.

Having completed his selection of puck trajectory, the offensive player closes the lid 24 so as to conceal his selection from the defensive player operating the miniature goalie 18. He then positions the shooter 22 in a desired position in front of the goal 17 and induces a shot by pushing the trigger 27 against the bias of the spring 92. Movement of the trigger pin into the housing 23 rotates the release mechanism 91 about the pivots 88 moving the rear portion 94 with the recesses 98 upwardly. This releases the yoke 52 which is driven forward by the springs 53 propelling the puck 50 along the ramp 84 and out of either the upper or lower discharge opening 26 in the housing 23. Since the actuator 31 is recessed substantially within the housing 23 behind the openings 26 the selected vertical and horizontal settings are not apparent to the defensive player handling the miniature goalie 18. Consequently, that player can only guess as to the selected trajectory when determining where to position the goalie member 18. Obviously, the passage of a puck by the goalie member 18 into the goal 17 constitutes a score for the offensive player.

At any time prior to the shot the offensive participant can instantaneously produce variations in the firing trajectory that is initially set by the horizontal and vertical adjustment of the actuator 31. Such variations are achieved by appropriate manipulation of the shooter housing 23. Horizontal variations are produced by rotating the shooter 22 in a horizontal plane on the playing surface 12. Vertical variations are accomplished by rocking the shooter's bottom surface 36 on the playing surface 12 so as to alter the elevation of the discharge orifices 26.

Obviously, many modifications and variations of the present invention are possible in light of the above teachings. It is to be understood, therefore, that the invention can be practiced otherwise than as specifically described.

What is claimed is:

1. A hockey game comprising:

a miniature hockey goal for positioning on a playing surface;

a goalie member horizontally and vertically movable in front of said goal by a player attempting to intercept pucks shot on goal;

a miniature puck for shooting on goal;

a shooter having an actuator for receiving said puck, said actuator comprising a spring loaded firing mechanism manually energized and releasable to propel said puck in predetermined trajectories, said shooter being manually manipulatable by an opponent into selective orientations that establish said predetermined trajectories and comprising further vertical adjustment means for manually setting the vertical position of said actuator so as to establish the vertical component of said trajectories; and a housing means for concealing said actuator from said player so as to keep secret therefrom the selected vertical trajectory of said puck.

2. A game according to claim 1 wherein said actuator comprises horizontal adjustment means for normally setting the horizontal position of said actuator so as to establish the horizontal component of said trajectories.

3. A game according to claim 1 wherein said housing means defines a discharge orifice through which said puck is propelled and a non-planar bottom surface adapted to be rocked on said playing surface so as to alter the elevation of said discharge orifice.

4. A game according to claim 3 wherein said actuator is recessed in said discharge orifice so as to conceal from said player the selected vertical trajectory of said puck.

5. A game according to claim 4 wherein said actuator comprises horizontal adjustment means for normally setting the horizontal position of said actuator so as to establish the horizontal component of said trajectories.

* * * * *